United States Patent [19]

White et al.

[11] 4,395,854

[45] Aug. 2, 1983

[54] UNIVERSAL LATCH MEANS FOR DROP SEAL ASSEMBLY FOR A MOVEABLE WALL

[75] Inventors: Dean S. White; Scott A. Shaffer, both of New Castle, Ind.

[73] Assignee: American Standard Inc., New York, N.Y.

[21] Appl. No.: 216,591

[22] Filed: Dec. 15, 1980

[51] Int. Cl.[3] ..... E06B 7/18; E04B 1/343

[52] U.S. Cl. ..... 52/64; 52/71; 52/238.1; 52/726; 160/40

[58] Field of Search ..... 52/71, 283, 64, 591, 52/594, 726, 238.1; 160/40, 229

[56] References Cited

U.S. PATENT DOCUMENTS

| | | | |
|---|---|---|---|
| 1,473,767 | 11/1923 | Healy | 52/591 |
| 3,063,105 | 2/1960 | Hollands | 160/229 R |
| 3,235,915 | 2/1966 | Glaser | 52/64 |
| 3,250,314 | 5/1966 | Wetzel | 160/40 |
| 3,300,899 | 1/1967 | Haws et al. | 52/64 |
| 3,302,341 | 2/1967 | Konopasek | 52/64 |
| 3,802,480 | 4/1974 | Daggy | 160/40 |
| 4,008,931 | 2/1977 | Kennedy, Jr. et al. | 52/594 |

FOREIGN PATENT DOCUMENTS

| | | | |
|---|---|---|---|
| 778582 | 12/1934 | France | 52/594 |

*Primary Examiner*—Alfred C. Perham

*Attorney, Agent, or Firm*—James J. Salerno, Jr.; Robert G. Crooks; John P. Sinnott

[57] ABSTRACT

A universal latch means for a drop seal assembly which is adapted for mounting to the lower end of a movable wall assembly, is disclosed. The drop seal assembly includes a universal latch means mounted on each end thereof for releasibly coupling each adjacent drop seal assembly in longitudinal alignment and in which each panel is locked from transverse relative movement. The latch means includes an alternating tongue and groove so that the tongue of one latch means nests into the complimentary groove of the adjacent latch means to releasibly lock each adjacent drop seal in longitudinal alignment and each panel is locked against vertical, horizontal and transverse movement.

4 Claims, 9 Drawing Figures

UNIVERSAL LATCH MEANS FOR DROP SEAL ASSEMBLY FOR A MOVEABLE WALL

BACKGROUND OF THE INVENTION

1. Field of the Invention

This invention relates to a drop seal assembly adapted for use with movable and/or track mounted wall panels and, more particularly, to a universal latch means which are asymmetrically mounted at each end of the drop seal assembly, so that the tongue of one of the universal latch means nests within the groove of an adjacent universal latch means, whereby the drop seal assembly of each adjacent panel is in longitudinal alignment and each drop seal is locked against transverse movement.

2. Review of the Prior Art

Several systems are presently employed which utilize continuous hinged panels having drop seal assemblies to lock each adjacent panel in longitudinal alignment. This is accomplished by providing means for shifting the drop seal of one panel longitudinally so that an end of the drop seal extends from the bottom edge of the panel into a corresponding opening of the adjacent panel. Another means for accomplishing longitudinal alignment of a drop seal assembly is to provide a male and female cone and caps mounted at opposite ends of a drop seal assembly. The drop seal assemblies are maintained in a longitudinal alignment by nesting the protruding cone of one cap into the complimentary female cone of the adjacent drop seal assembly. In the former, a mechanism must be provided whereby the drop seal assembly can be shifted longitudinally; this requires perfect longitudinal alignment and an expensive assembly for mounting the drop seal assembly to a movable wall panel. In the latter, the male and female cone-shaped cap members require pairs to be used on each panel, so that each panel must be aligned male to female, also requiring an additional element to be stocked to complete the latch assembly.

SUMMARY OF THE INVENTION

It is accordingly an object of the invention to provide a drop seal assembly having a universal latch means mounted on its ends, whereby longitudinal alignment of the adjacent drop seal assembly is automatically achieved when the panels are brought into longitudinal alignment and which, additionally, prevents transverse movement relative thereto.

Another object of the invention is to provide a universal latch means which requires only a single part to be stocked and which are asymmetrically mounted.

Another object of the invention is to provide an inexpensive moldable latch member of relatively simple, but unique, design which is easy to mount to a drop seal assembly.

In accordance with the objectives of the present invention, it is generally contemplated to provide a universal latch means for a drop seal assembly adapted for use with a movable wall panel. The drop seal assembly includes a channel for shiftably mounting to the bottom of the moveable wall panel. Universal latch means are mounted at each end of the drop seal assembly. The latch means includes a face having an alternating tongue and groove, having vertically camming surfaces which guide adjacent seals into mating alignment, so that the tongue of one universal latch means nests into the groove of the adjacent universal latch means. The drop seal assembly is adapted to be shiftable to a raised inoperative position while moving or storing the panels, and to a lowered operative position when the panels are positioned in longitudinal alignment.

DESCRIPTION OF THE PREFERRED EMBODIMENT

Figure 1:
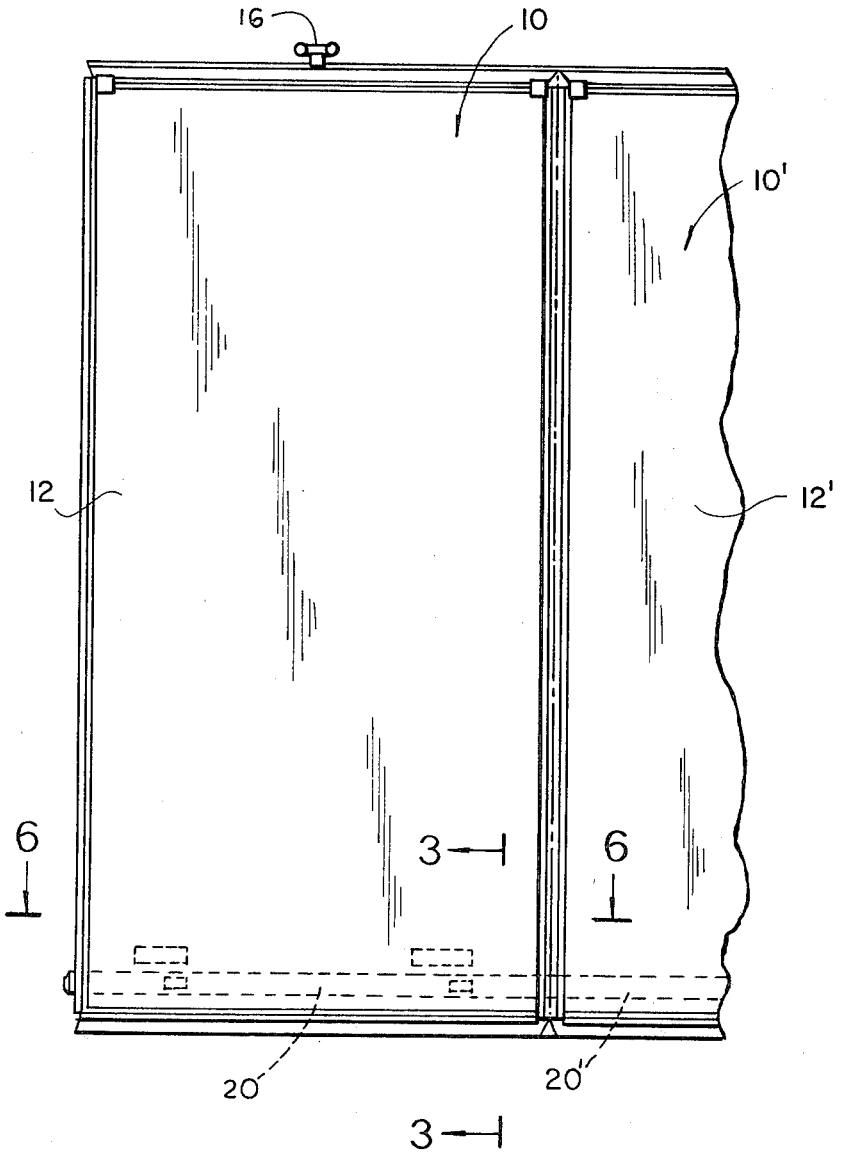
FIG. 1 is an elevational view of a panel fully assembled with a fragmentary section of an adjacent panel illustrating the connection made by the universal latch means of the invention herein.
Figure 2:
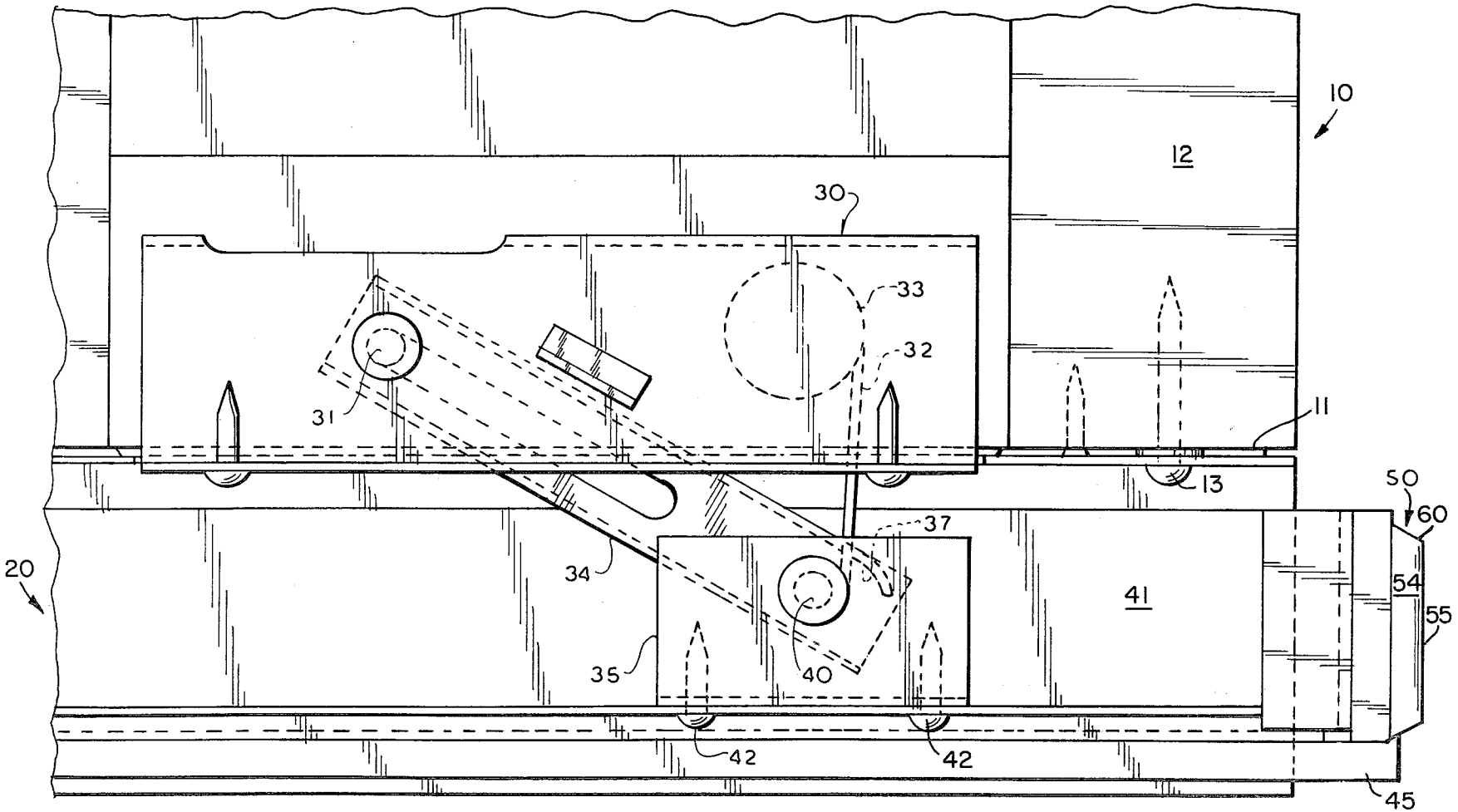
FIG. 2 is a side elevational view of the drop seal assembly having the universal latch means mounted at each end thereof.
Figure 6:
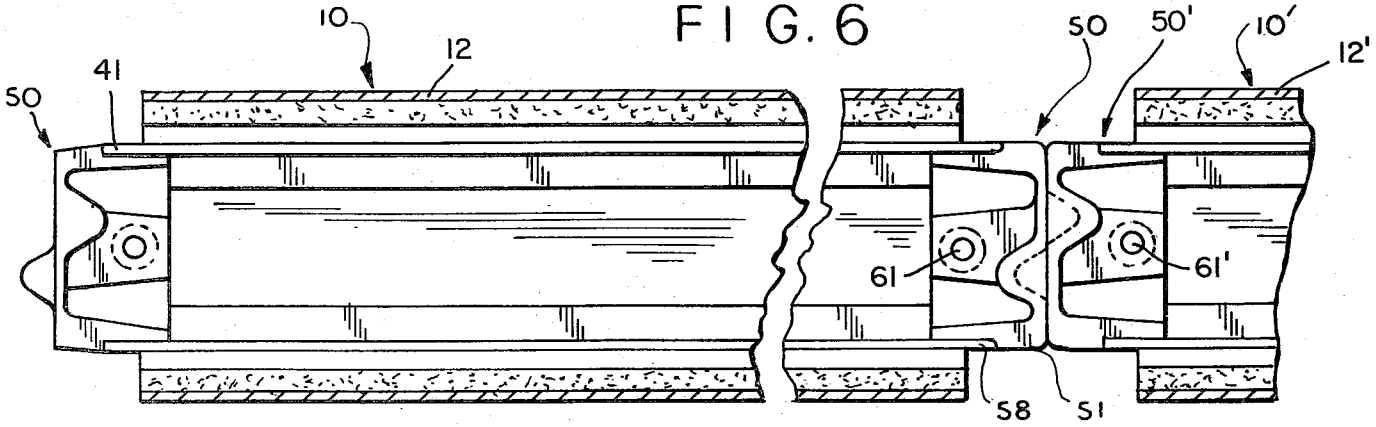
FIG. 6 is a sectional view taken along the lines 6—6 of FIG. 1.

In FIGS. 1 and 6, wall panel 12 of a movable wall assembly 10 is shown in which drop assembly 20 of panel 12 is positioned in longitudinal alignment with a wall panel 12', shown broken away. Drop seal assembly 20 is best illustrated mounted in the down or operative position in FIG. 3, and in its up or inoperative position in FIG. 4. In FIG. 2, drop seal assembly 20 is shown in the inoperative position fully mounted in panel 12.

Shown in FIGS. 2–5, drop seal assembly 20 includes channel retainer 22 which is mounted to the bottom face 11 of panel 12 by screws 13. Shown in FIGS. 3 and 4, a hardboard liner 21 is positioned along the inner face 23 of channel retainer 22 and is mounted in place by longitudinally-extending U-shaped channel 24, formed integrally with channel retainer 22. Formed integrally below U-shaped channel 24, is longitudinally-extending slot 25 adapted to receive a resilient seal, not shown.

Figure 3:
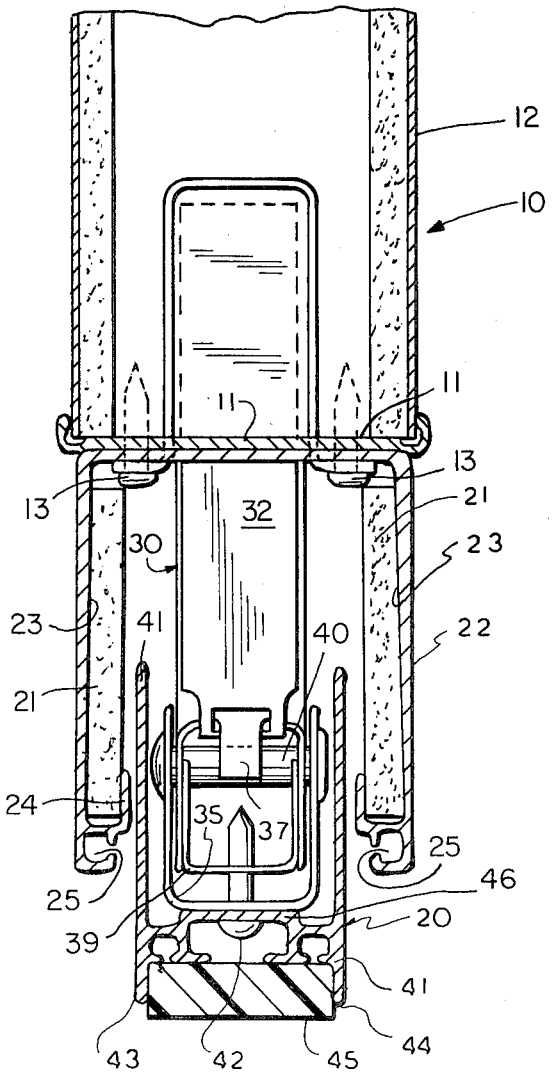
FIG. 3 is an elevational view in section taken along the lines 3—3 of FIG. 1.
Figure 4:
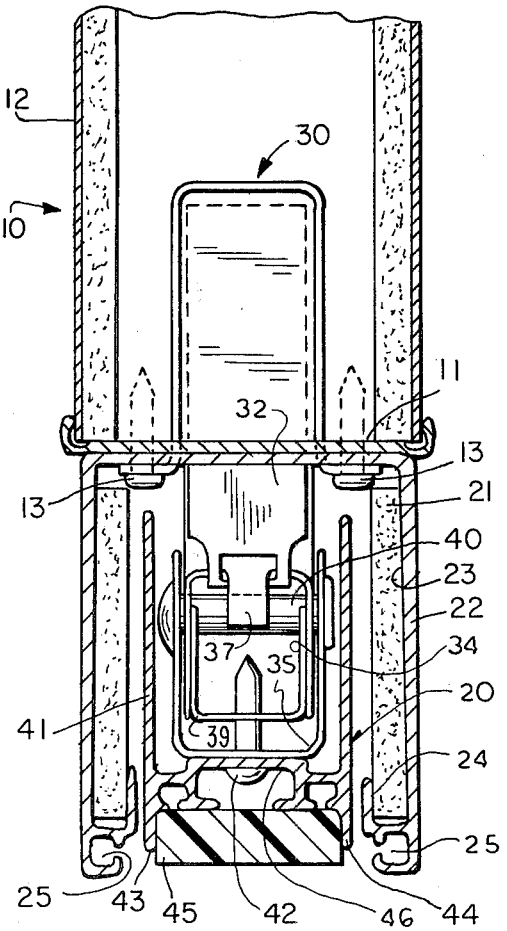
FIG. 4 is a view similar to FIG. 3 illustrating the drop seal assembly in its up, or inoperative position.
Figure 5:
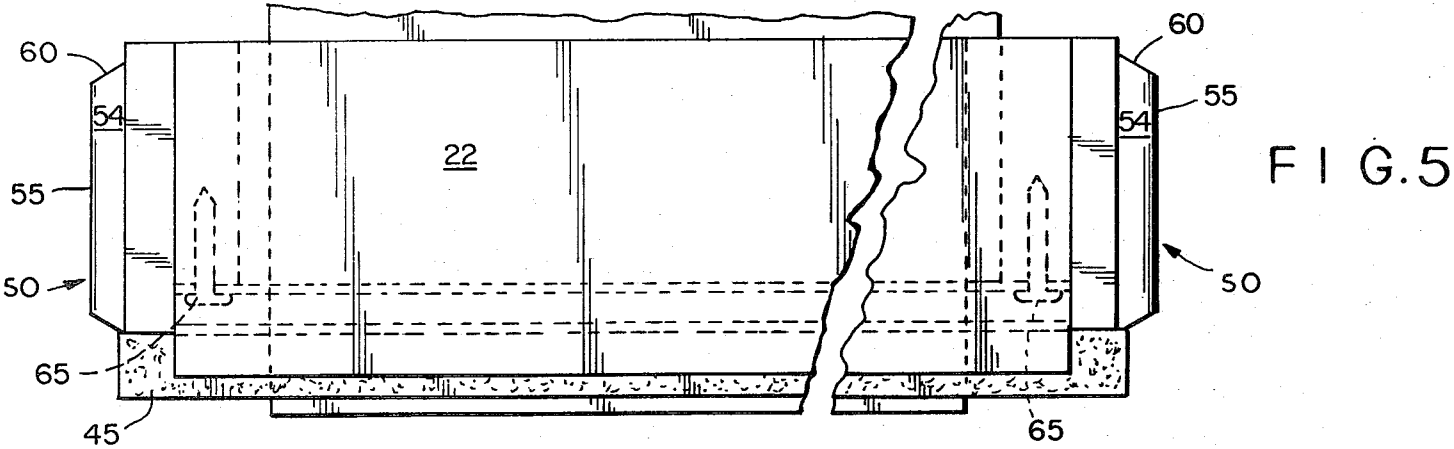
FIG. 5 is an elevational view of the latch means mounted at each end of the drop channel of the seal assembly.
Figure 7:
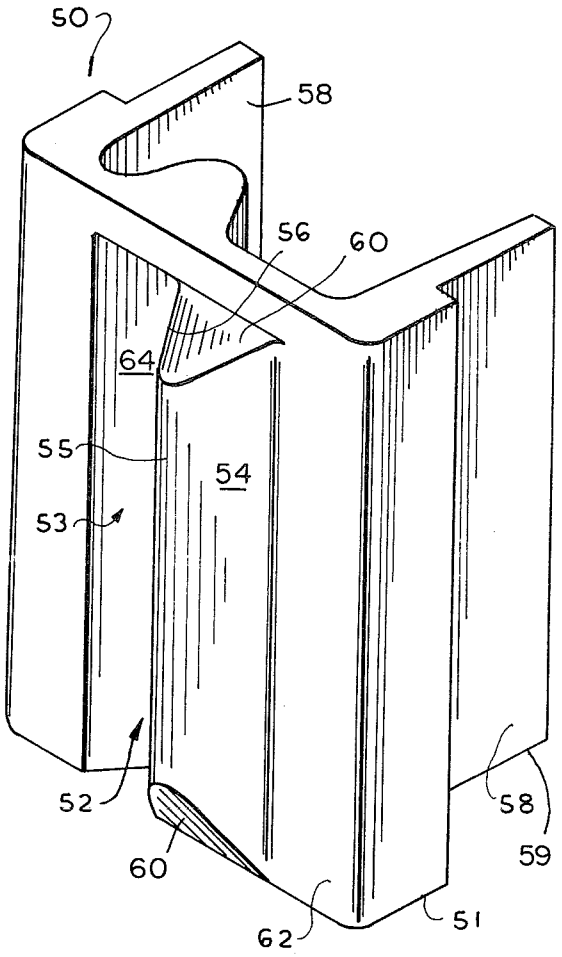
FIG. 7 is an isometric view of the universal latch means as seen from the front.
Figure 8:
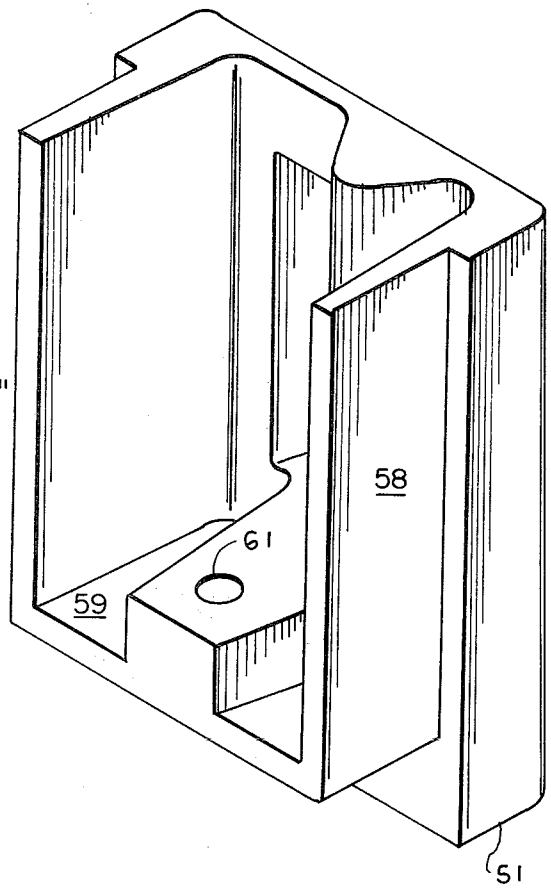
FIG. 8 is an isometric view of the universal latch means as seen from the rear.

Spring assembly 30 is mounted in panel 12 as shown in FIG. 2. Spring assembly 30 includes a constant force spring 32 to retract drop seal assembly 20 within channel retainer 22. The force exerted by constant force spring 32 counterbalances the drop seal assembly 20, so that drop seal 20 will normally be retained in the up, or inoperative, position shown in FIGS. 1 and 3. Constant force spring 32 is coiled around pulley 33 at one end and coupled to pivot arm 34 on ear 37 at its other end; as shown in FIGS. 3 and 4. Pivot arm 34 is pivotally mounted in panel 12 on pin 31. Bracket 35 is pivotally mounted on pivot arm 34 through pin 40. Bracket 35 is mounted to drop seal channel 41 by screws 42. Drop seal channel 41 extends across the width of panel 12 and is telescopically received in drop channel retainer 22. Mounted on opposite ends of drop seal channel 41, is universal latch means 50 and is most clearly illustrated in FIGS. 7 and 8. Universal latch means 50 includes a pair of parallel, spaced, rearwardly-extending vertical walls 58, inwardly formed with vertical face 51. Walls 58 are spaced slightly inwardly along the longitudinal edges of vertical face 51, a distance substantially equal to the width of drop channel retainer 22. Base 59 is spaced upwardly from the lower edge, a distance equal to the height of base 46 of drop channel 41, so that resilient floor seal 45 can be mounted without interruption between depending legs 43 and 44 in a continuous strip equal to the width of panel 12. Base 59 extends rearwardly of base 51 and is inwardly formed between rearwardly-extending walls 58. Universal latch means 50 is mounted in drop channel 41 by self-tapping screw 65 through opening 61 formed in base 59. Drop seal channel 41 is mounted to bracket 35 on housing 39 by self-tapping screws 42. Drop seal channel 41 includes depending legs 43 and 44 between which is mounted resilient floor seal 45, shown in fixed position in FIGS. 3 and 4. Universal latch means 50 is preferably of unitary design and formed of a moldable plastic material such as a thermo-plastic polyester, sold under the trade name Valox by General Electric Co.

Universal latch means 50 includes an alternating tongue 52 and groove 53 formed on vertical face 62. Tongue 52 is shaped in the form of an elongated triangular pyramid having a short side 54 which extends angularly from face 62 and terminates in a curved ridge 55. Depending angularly away from curved ridge 55 is an elongated common side 56 of both tongue 52 and groove 53. Side 56 terminates in a corresponding U-shaped curve 57 in which short side 64 extends angularly to vertical face 62. Short side 54 of tongue 52 and short side 64 of groove 53 correspond in height and are parallel to each other. Tongue 52 includes camming surface 60, which facilitates the insertion of tongue 52 into a corresponding groove 53′ of adjacent latch means 50′, shown mounted in FIG. 6. Camming surface 60 facilitates alignment of drop seal assembly 20 when being lowered from its inoperative position, shown in FIG. 4, to its floor seal or operative position, shown in FIG. 3. When adjacent latches 50, 50′ are engaged, one in the other, vertical locking occurs which prevents relative vertical movement. Tongue 52 and groove 53 also provide transverse stability for panel 12 and drop seal assembly 20, since the tongue of each latch means is inserted into the corresponding groove of the adjacent latch means.

Figure 9:
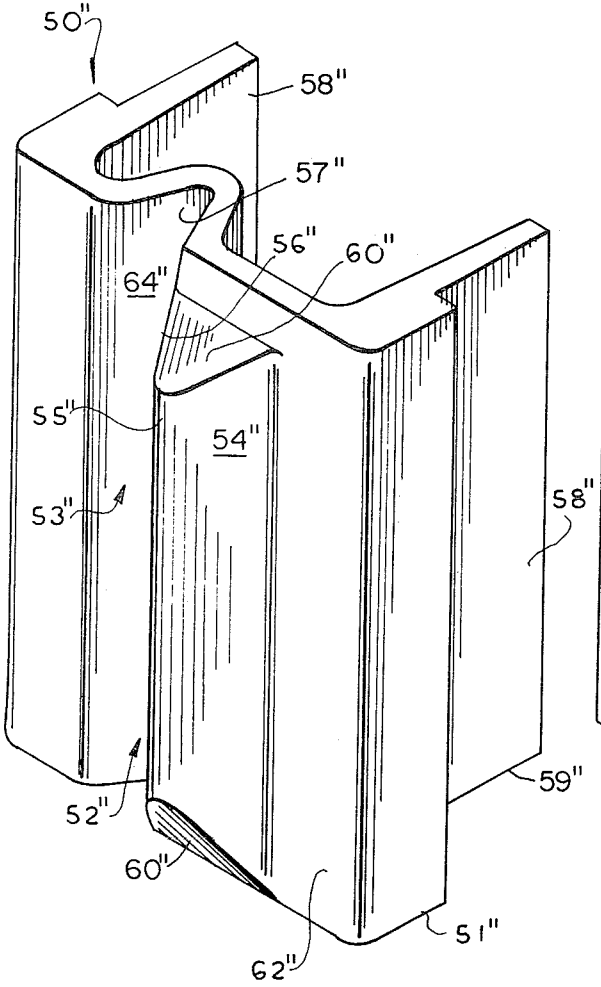
FIG. 9 is an isometric view of an alternate design of the universal latch means as seen from the front.

In FIG. 9, an alternate design of a universal latch means 50″ is illustrated wherein the top rim or stop of groove 53 is removed to permit drop seal assembly 20 to be operated in a vertical direction when panels 12 are in abutting relation. The alternate design of universal latch means 50″ is used when panels 12 are in place and each drop seal 20 is operated individually. The removal of the stop from groove 53 allows relatively vertical sliding movement of adjacent drop seal assemblies 20, 20′. Thus, corresponding drop seal assemblies 20, 20′ will be aligned longitudinally and transversely, but permits relative movement in the vertical direction.

In operation, panel assembly 10 is moved into its extended position by trolley means 16 which is mounted on the top of panel 12, along a track, not shown. Also, panels 12, 12′, are conveniently hinged to provide a fan-fold assembly, so that when panel 12 is moved into position, each panel, being hingedly connected together, will move into longitudinal alignment before drop seal assembly 20 is lowered to its operative seal position, as shown in FIG. 3. As indicated above, when drop seal assembly 20 is lowered to its operative position, latch means 50 facilitates both longitudinal alignment and prevents transverse movement with respect to adjacent panels 12, 12′.

What is claimed:

1. A latch means adapted for mounting to a drop seal assembly of a movable panel, said latch means comprising: a front, vertical face having formed thereon in side-by-side relation, a pair of elongated triangular pyramids, one being the mirror image of the other so as to provide a tongue and groove latching means, and each pair of said triangular pyramids having a common side, said tongue pyramid having a camming surface so that when said tongue pyramid of one latch means is inserted into a groove pyramid of an adjacent latch means, said camming surface will cause said tongue pyramid to follow along the corresponding surfaces of said groove pyramid of the adjacent latch means, so that the drop seal assembly of said adjacent panel is mounted in longitudinal alignment and are locked against transverse movement.

2. The latch means of claim 1, wherein said camming surface is a bevelled surface formed at one end of said tongue pyramid.

3. A movable wall panel having a shiftable drop seal assembly operatively mounted at the bottom thereof, said drop seal assembly arranged and constructed to facilitate longitudinal alignment of said movable wall panel with an adjacent wall panel, the improvement comprising:

a latch means mounted to said drop seal assembly, said latch means including a front, vertical face having formed thereon in side-by-side relation, a pair of elongated triangular pyramids, one being the mirror image of the other so as to provide a tongue and groove latching means, and each pair of triangular pyramids having a common side, said tongue pyramid having a camming surface so that when said tongue pyramid of one latch means is inserted into a groove pyramid of an adjacent latch means of said adjacent panel, said camming surface will cause the tongue to follow along the corresponding surfaces of said groove pyramid of the adjacent latch means so that said drop seal assemblies are mounted in longitudinal alignment and are locked against transverse movement.

4. The latch means of claim 3 includes a latch means mounted asymmetrically at each end of said drop seal assembly.

* * * * *